US005899158A

United States Patent [19]

Yoshida et al.

[11] Patent Number: 5,899,158

[45] Date of Patent: May 4, 1999

[54] PROGRAMMABLE ELECTRONIC SEWING MACHINE

[75] Inventors: Shinji Yoshida, Nagoya; Kazushi Inoue, Aichi-gun; Yoshihiro Hara, Kasugai; Minoru Yamaguchi, Kariya, all of Japan

[73] Assignee: Brother Kogyo Kabushiki Kaisha, Nagoya, Japan

[21] Appl. No.: 09/084,226

[22] Filed: May 26, 1998

[30] Foreign Application Priority Data

May 27, 1997 [JP] Japan ..... 9-136877

[51] Int. Cl.[6] ..... D05B 19/02

[52] U.S. Cl. ..... 112/470.01; 112/102.5

[58] Field of Search ..... 112/470.01, 102.5, 112/470.06, 220, 221, 456, 277, 458; 364/470.09

[56] References Cited

U.S. PATENT DOCUMENTS 4,108,093 8/1978 Watanabe et al. ..... 112/458
4,459,926 7/1984 Ohniwa ..... 112/102.5

*Primary Examiner*—Peter Nerbun
*Attorney, Agent, or Firm*—Oliff & Berridge, PLC

[57] ABSTRACT

A programmable electronic sewing machine includes sewing control means for controlling sections of the machine including a main shaft on the basis of a preset program so that a sewing operation is executed, rotational speed setting means for setting a rotational speed of the main shaft according to an amount of operation thereof, upper limit calculating means for calculating an upper limit settable as the rotational speed of the main shaft on the basis of the preset program, and displaying means for displaying the rotational speed of the main shaft currently set by the rotational speed setting means with the upper limit calculated by the upper limit calculating means serving as an upper limit of the displayed rotational speed.

20 Claims, 8 Drawing Sheets

PROGRAMMABLE ELECTRONIC SEWING MACHINE

BACKGROUND OF THE INVENTION

1. Field of the Invention

This invention relates to a programmable electronic sewing machine which executes a sewing operation on the basis of a predetermined program.

2. Description of the Related Art

Conventional programmable electronic sewing machines comprise sewing control means for controlling various mechanisms including a main shaft on the basis of a predetermined program so that a sewing operation is executed, and speed setting means for setting a rotational speed of the main shaft. In the programmable electronic sewing machines, complicated sewing manners such as pattern sewing can readily be executed automatically or semiautomatically by the sewing control means. Furthermore, the speed setting means includes a speed adjusting dial operated so that the rotational speed of the main shaft is varied. Consequently, a sewing speed can be adjusted according to a required cycle time.

The speed adjusting dial of the speed setting means has a circular scale. However, the speed setting means has no arrangement for displaying the currently set rotational speed of the main shaft. Accordingly, in order that a cycle time may be calculated, the sewing operation needs to be actually executed so that an actual sewing speed is obtained. Thus, the calculation of the cycle time results in difficulty. The prior art has proposed a display provided on an operation panel of the sewing machine so that the main shaft speed set by the speed adjusting dial of the speed setting means is displayed on the display. However, this arrangement results in the following problem. Differing from sewing machines dedicated to the sewing of a straight stitch, the programmable sewing machine is designed to be capable of forming unequal stitches with different stitch pitches according to the entered program. The main shaft can be rotated at high speeds when the stitch pitch is small. However, the main shaft needs to be rotated at low speeds when the stitch pitch is large. The reason for the above-described rotating manner is that a time needs to be gained for horizontally moving a needle relative to a workpiece cloth. In view of this, the main shaft speed is automatically reduced in the programmable electronic sewing machine when the main shaft speed is set at a large value and the stitch pitch is so large that the sewing cannot be executed at the set rotational speed. This does not apply to a sewing machine provided with a needle bar jumping mechanism. However, the sewing machine with such a needle bar jumping mechanism is expensive and is directed to special purposes.

Thus, in the conventional programmable electronic sewing machine, the actual main shaft speed is sometimes rendered lower than a high speed set by the speed setting means depending upon the program. In this case, the cycle time cannot accurately be calculated even when the display is provided for displaying the set speed of the main shaft.

SUMMARY OF THE INVENTION

Therefore, an object of the present invention is to provide a programmable electronic sewing machine in which the set rotational speed of the main shaft can be displayed to correspond to a substantial value according to the program.

The present invention provides a programmable electronic sewing machine comprising sewing control means for controlling sections of the machine including a main shaft on the basis of a preset program so that a sewing operation is executed, rotational speed setting means for setting a rotational speed of the main shaft according to an amount of operation thereof, upper limit calculating means for calculating an upper limit settable as the rotational speed of the main shaft on the basis of the preset program, and displaying means for displaying the rotational speed of the main shaft currently set by the rotational speed setting means with the upper,limit calculated by the upper limit calculating means serving as an upper limit of the displayed rotational speed.

According to the above-described arrangement, the upper limit calculating means calculates the upper limit settable as the rotational speed of the main shaft on the basis of the sewing program. The currently set rotational speed of the main shaft is displayed as having the calculated upper limit. More specifically, when the speed setting means is operated so that the rotational speed of the main shaft is increased, the numeric value displayed on the display and the set rotational speed are increased according to the amount of operation of the speed setting means. However, when the rotational speed has reached the upper limit, the numeric value displayed on the display is not varied even if the speed setting means is operated. Furthermore, the value set as the rotational speed is not increased above the upper limit. Thus, the rotational speed of the main shaft is displayed as the numeric value according to the program. Consequently, the cycle time etc. can be calculated readily and accurately.

In a preferred form, the sewing machine further comprises lower limit calculating means for calculating a lower limit settable as the rotational speed of the main shaft. In this arrangement, the displaying means preferably displays the currently set rotational speed of the main shaft with the upper and lower limits serving as the upper limit and a lower limit of the displayed rotational speed respectively.

In another preferred form, the upper limit calculating means reads the program to detect a minimum value of a stitch pitch and calculates the upper limit on the basis of the detected minimum value of the stitch pitch.

In further another preferred form, the upper limit calculating means reads the program to detect a maximum value of a stitch pitch and calculates the upper limit on the basis of the detected maximum value of the stitch pitch.

BRIEF DESCRIPTION OF THE DRAWINGS

Other objects, features and advantages of the present invention will become clear upon reviewing the following description of preferred embodiments thereof, made with reference to the accompanying drawings, in which.

DETAILED DESCRIPTION OF THE PREFERRED EMBODIMENTS

Figure 1:
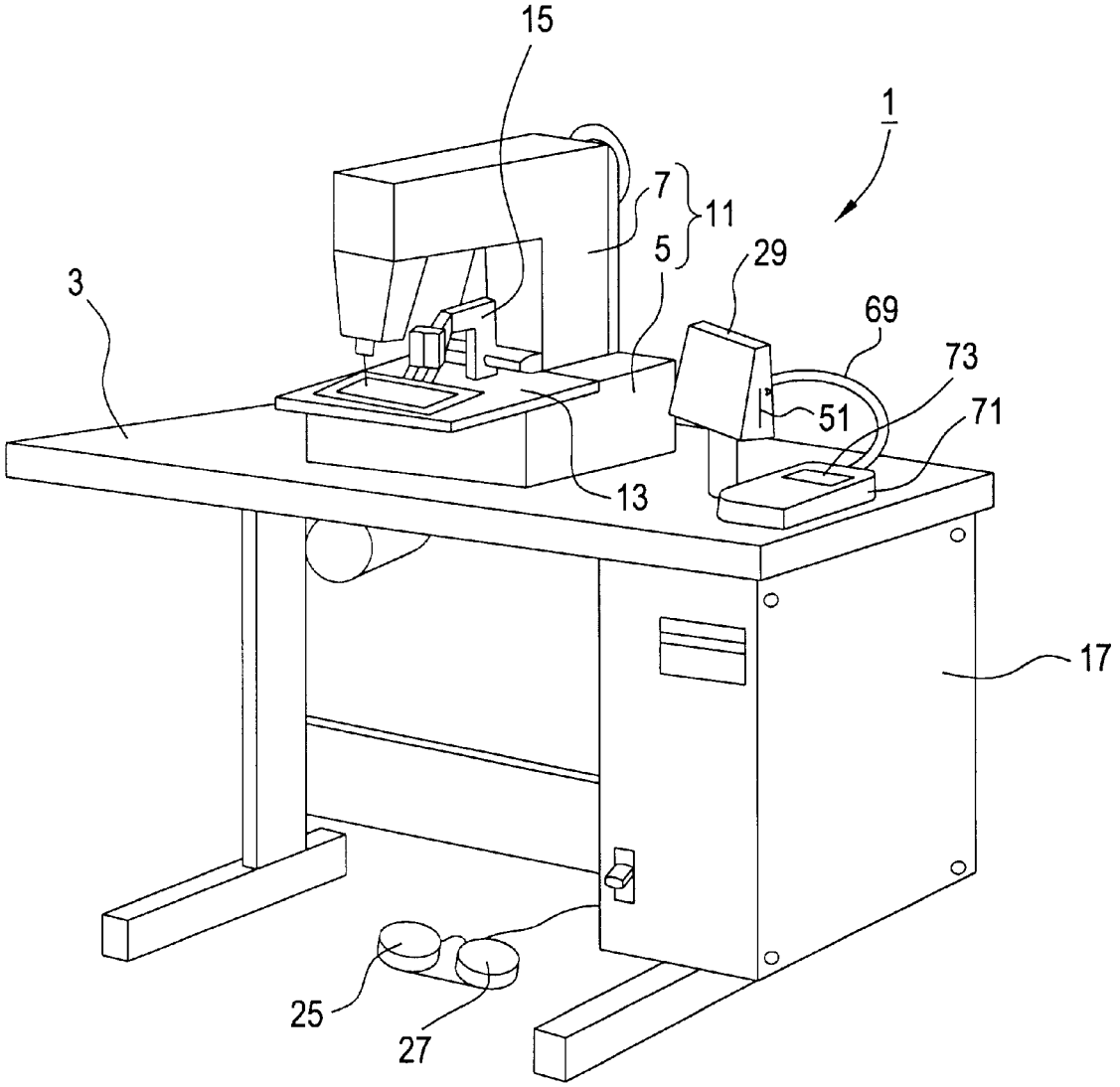
FIG. 1 is a perspective view of a programmable electronic sewing machine of a first embodiment in accordance with the present invention.

A first embodiment of the present invention will be described with reference to FIGS. 1 to 6. Referring to FIG. 1, the programmable electronic sewing machine 1 of the first embodiment is shown. The shown sewing machine 1 is an electronically controlled pattern sewing machine of the pattern seamer type executing a pattern sewing such as a name sewing for sewing personal names etc. on a workpiece cloth.

The sewing machine 1 includes a sewing table 3, a sewing bed 5 mounted on the sewing table 3, and an arm 7 extending vertically from the rear of the sewing bed 5 and then horizontally frontward, as shown in FIG. 1. The bed 5 and the arm 7 constitute a body 11 of the sewing machine 1. A needle plate 13 is fixed on the front upper face of the sewing bed 5. A cloth presser 15 is provided over the needle plate 13. The cloth presser 15 is moved in the X direction by an X-axis motor 21 (see FIG. 4) and in the Y direction by a Y-axis motor 23 (see FIG. 4). Each of the X-axis and Y-axis motors 21 and 23 comprises a stepping motor, for example, and is controlled by a machine control device 17 provided on the right-hand end of the underside of the table 3. A presser switch 25 and a start switch 27 are connected to the control device 17. The presser switch 25 is operated so that a cloth presser plate 35 of the cloth presser 15 is moved upward and downward as will be described later. The start switch 27 is operated so that the sewing operation is started. An operation panel 29 stands on the upper face of the sewing table 3 on the right of the body 11.

Figure 2:
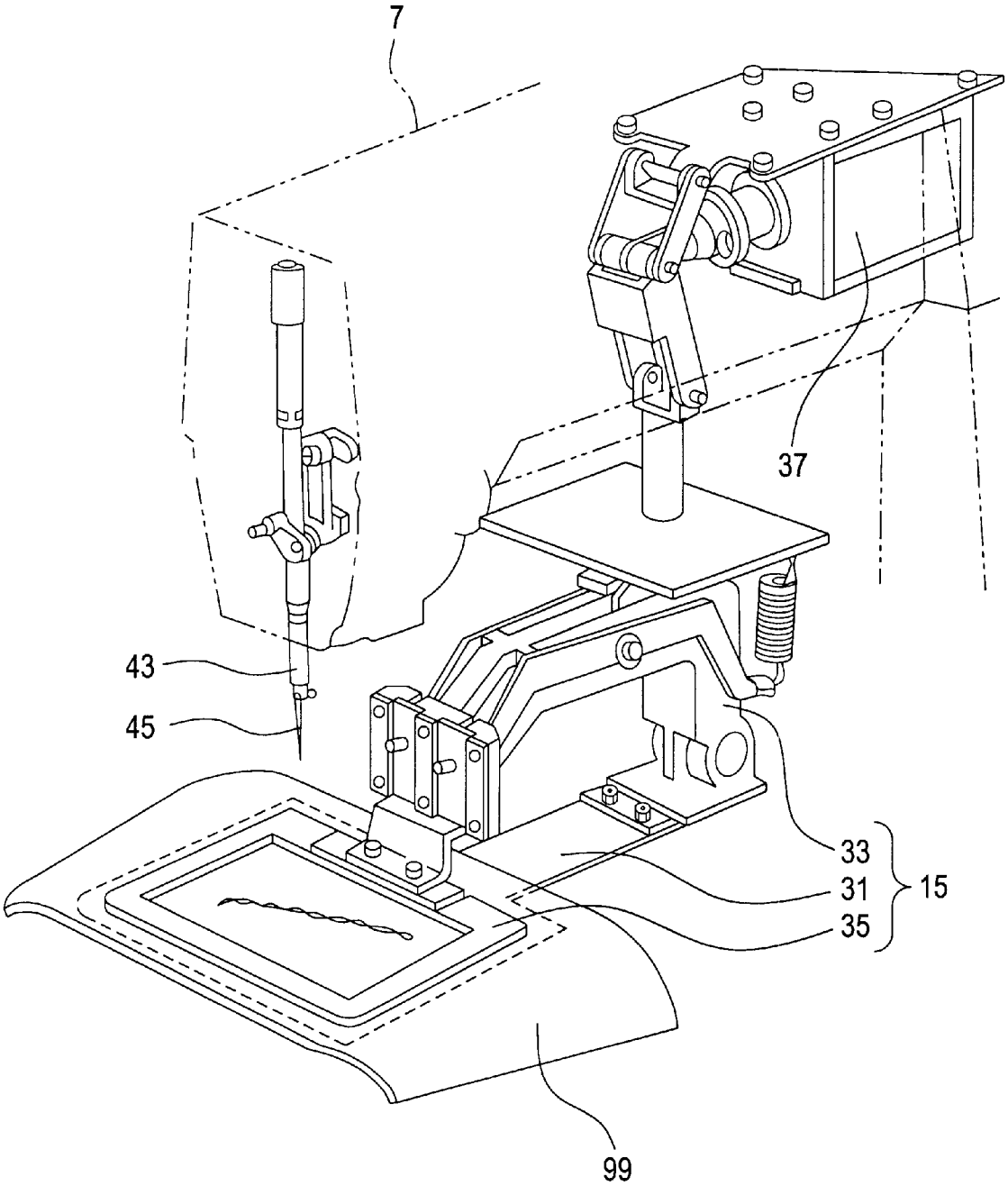
FIG. 2 is a perspective view of a cloth presser of the sewing machine.

Referring to FIG. 2, the cloth presser 15 includes a feed plate 31, a presser arm 33 and the cloth presser plate 35. The feed plate 31 is moved in the X and Y directions on the upper face of the needle plate 13 (see FIG. 1). The presser arm 33 is disposed on the right-hand end of the feed plate 31 as viewed in FIG. 2. The cloth presser plate 35 is disposed on the front end of the presser arm 33 for vertical movement. The cloth presser plate 35 is usually urged upward by a spring (not shown) so as to be away from the feed plate 31. Upon actuation of a presser solenoid 37 mounted on the arm 7, the cloth presser plate 35 is lowered onto the feed plate 31 against a spring force. As a result, a workpiece cloth 99 is held between the feed plate 31 and the cloth presser plate 35.

A needle bar 43 is mounted on the front end of the arm 7 so as to be moved vertically reciprocally. A sewing needle 45 is attached to a lower end of the needle bar 43. The needle bar 43 is driven via a needle bar driving mechanism (not shown) by a machine motor 41 (see FIG. 4). A shuttle (not shown) is rotatably mounted below the needle plate 13. The shuttle is driven via a shuttle driving mechanism (not shown) by the motor 41. The cloth presser 15 is moved in the X and Y directions by the X-axis and Y-axis motors 21 and 23 while the needle bar 43 and accordingly the needle 45 are vertically moved and the shuttle is rotated by the motor 41, so that a pattern sewing is executed on the cloth 99.

Figure 3:
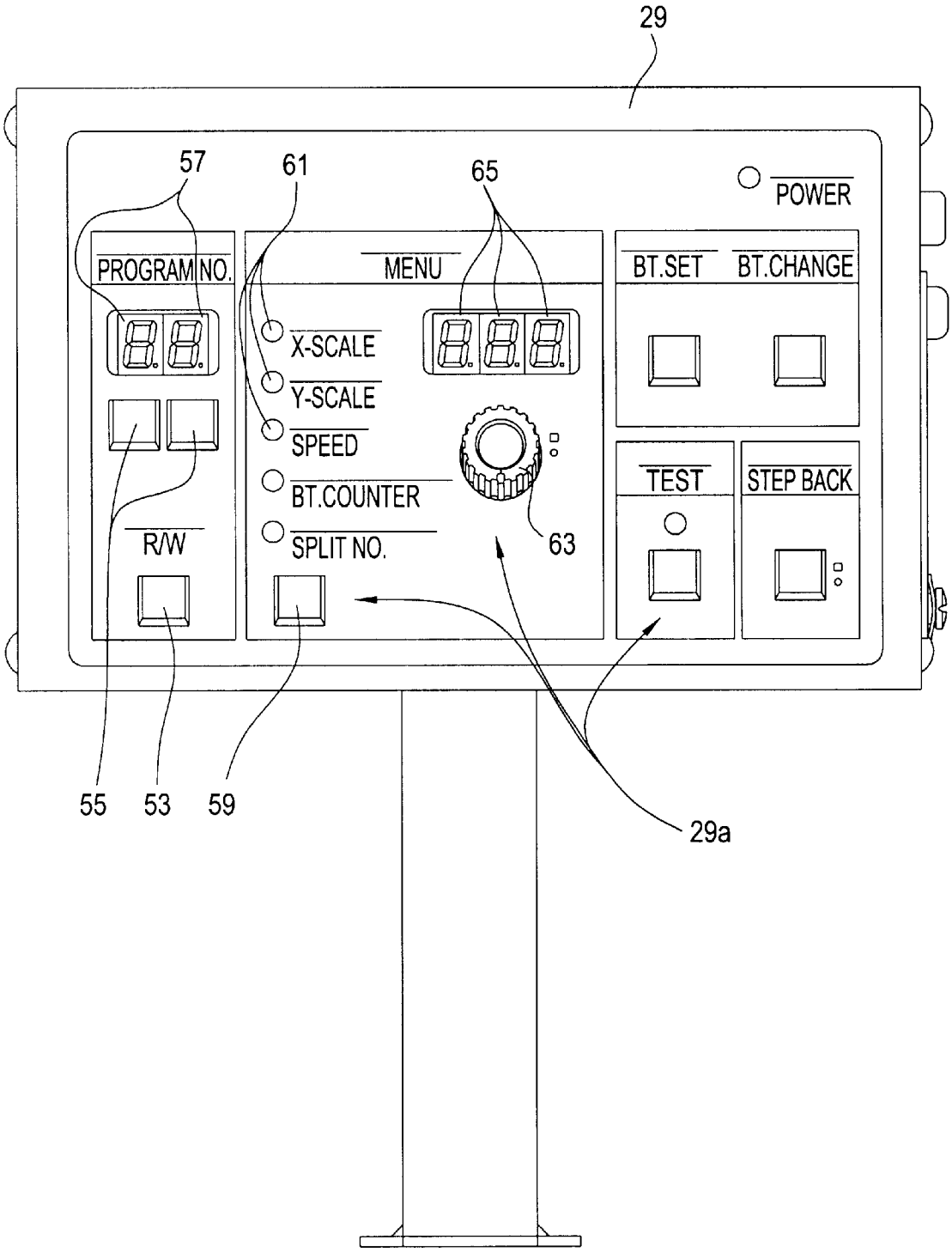
FIG. 3 is a front view of an operation panel of the sewing machine.

The operation panel 29 will now be described with reference to FIG. 3. The operation panel 29 comprises, on its front face, various switches and displays including a read/write switch 53, a pair of program number selecting switches 55, a pair of 7-segment type displays 57, a menu selecting switch 59, five menu lamps 61, a dial 63, and three 7-segment type displays 65. A floppy disk drive 51 is provided in the right-hand side of the operation panel 29 as shown in FIG. 1. The read/write switch 53 is operated so that programs for the sewing are read and written via the floppy disk drive 51. The program number selecting switches 55 are operated so that a program number of the program to be read or written is selected. The 7-segment type displays 57 display the selected program number in two digits. The menu selecting switch 59 is operated so that one of five items, "X-SCALE," "Y-SCALE," "SPEED," "BT. COUNTER," and "SPLIT NO." "BT." in "BT. COUNTER" refers to "BOBBIN THREAD." The menu lamps 61 are turned on when the respective items are selected. The dial 63 serves as operating means for changing numeric values set in connection with the respective items. The 7-segment type displays 65 display the numeric value set in connection with the selected item in three digits.

The 7-segment type displays 65 also display error numbers corresponding to the contents of errors. The first digit displays "E" indicative of occurrence of an error and the second and third digits display a two-digit number corresponding to the contents of the error. A connector (not shown) is provided on the left-hand side of the operation panel 29. A programmer 71 is detachably connected via a cable 69 to the connector, as shown in FIG. 1. The programmer 71 includes a liquid crystal display (LCD) 73 for displaying an icon for program composition, and the error contents and a recovery method in the form of sentence, and various key switches (not shown). When the key switches are operated, the programmer 71 sets an execution order of programs stored in a floppy disk installed in the floppy disk drive 51 and various parameters in the programs.

Figure 4:
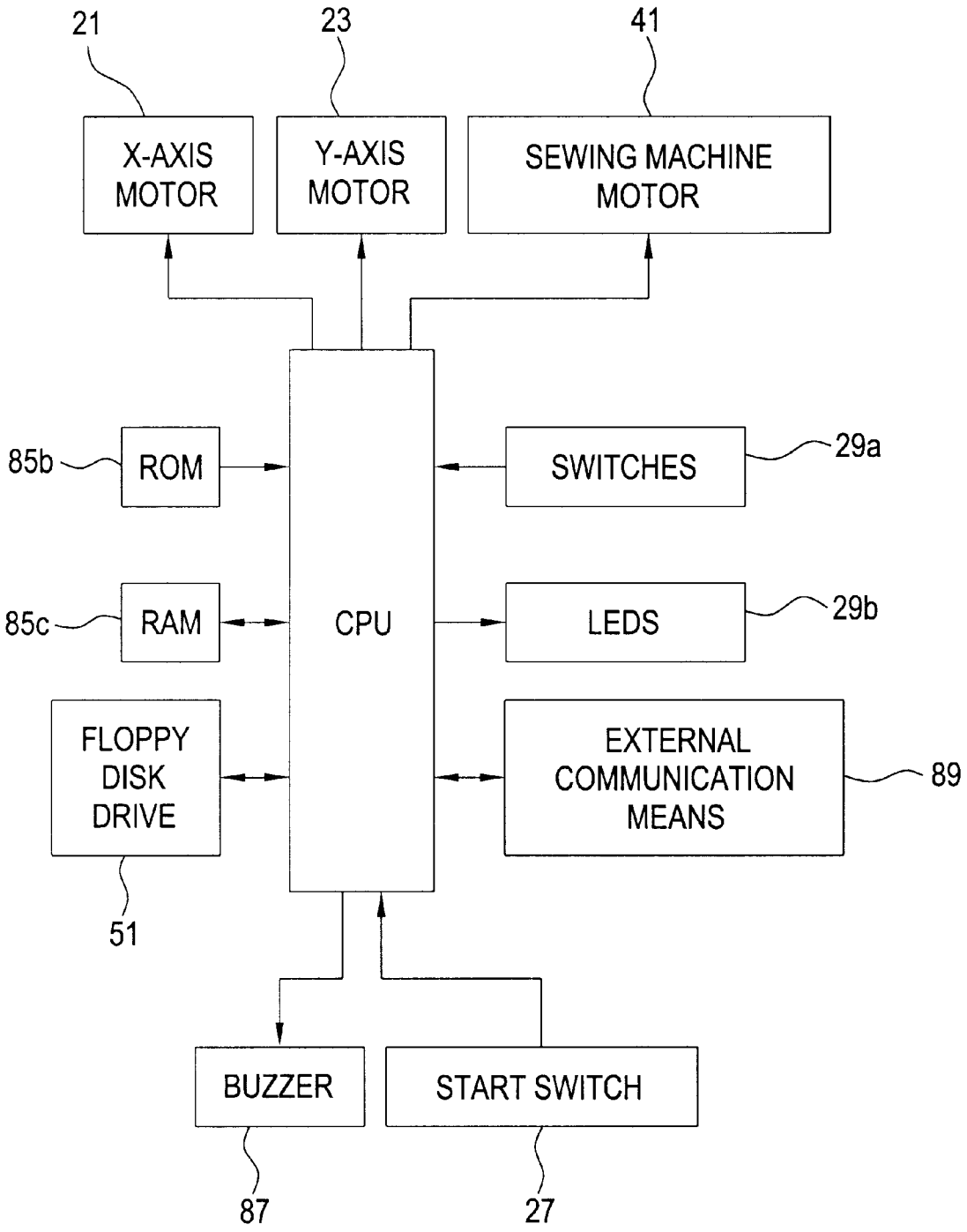
FIG. 4 is a block diagram of a control system of the sewing machine.

Referring to FIG. 4, an electrical arrangement of the control system of the sewing machine 1 is shown. A CPU 85*a* controls the overall operation of the sewing machine 1 and executes various control programs stored in a ROM 85*b*. A RAM 85*c* temporally stores various data during operation of the CPU 85*a*. The CPU 85*a* delivers drive signals to the X-axis and Y-axis motors 21 and 23 and the motor 41 to drive the motors. The CPU 85*a* is connected to the floppy disk drive 51 to read and write data from and into the floppy disk installed in the floppy disk drive 51. The CPU 85*a* is supplied with switch signals from the switches 29*a* of the operation panel 29 and delivers drive signals to the LEDs 29*b* (the 7-segment displays 57 and 65 and the menu lamps 61) to drive them. The CPU 85*a* further delivers a drive signal to the buzzer 87 so that the buzzer performs an alarming operation. The CPU 85*a* transmits and receives data to and from the programmer 71 via external communication means comprising the above-mentioned connector and an interface circuit. The CPU 85*a* is supplied with a switch signal from the start switch 27.

The operation of the control system or the control contents of the CPU 85*a* will now be described. The user operates the program number selecting switch 55 to select a desired program number. Thereafter, upon operation of the read/write switch 53, the CPU 85*a* reads the program corresponding to the selected program number from the floppy disk installed in the floppy disk drive 51. Then, when the start switch 27 is operated, the CPU 85*a* drives the motors 21, 23 and 41 on the basis of the read program so that the sewing operation is executed according to the program.

Figure 5:
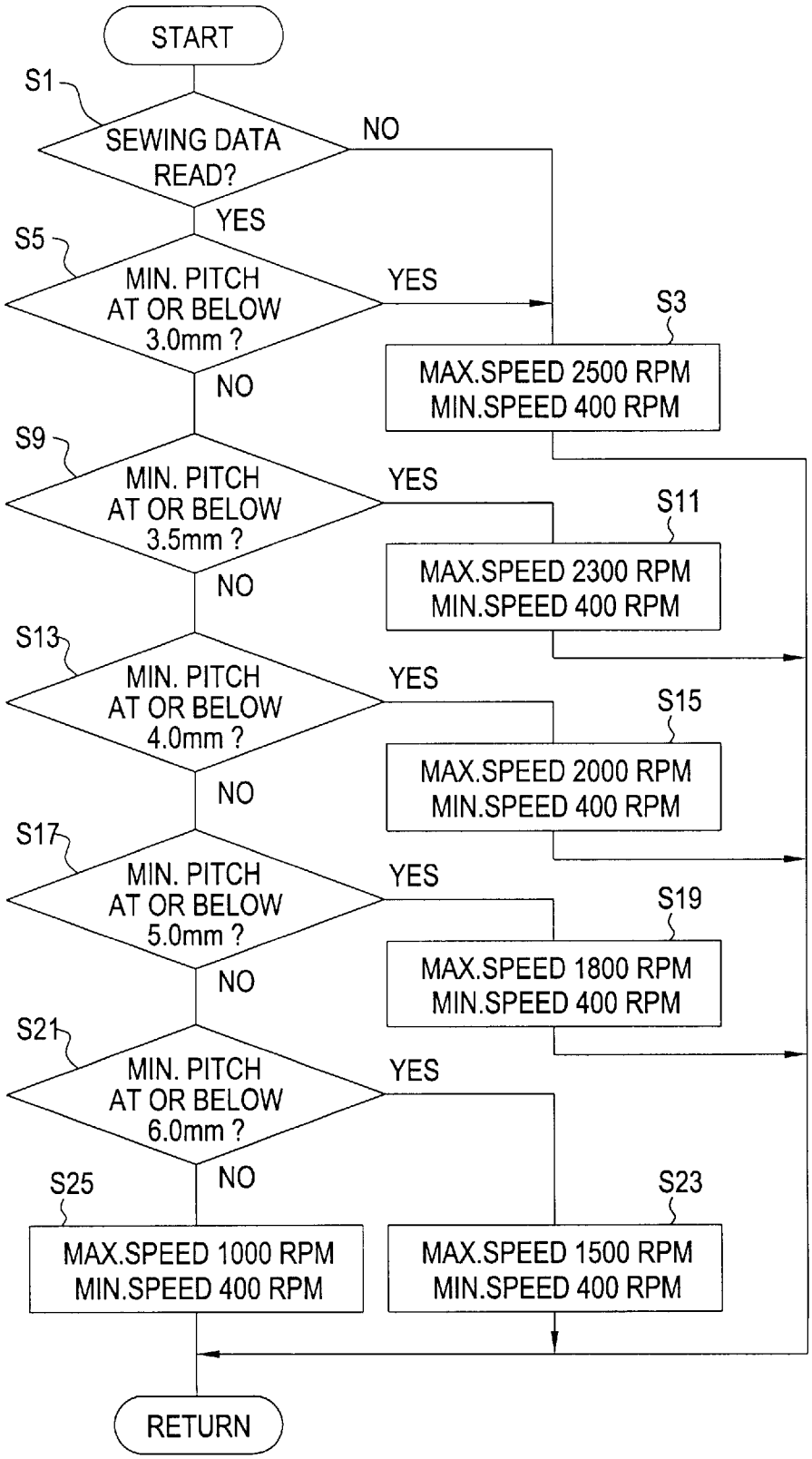
FIG. 5 is a flowchart showing upper and lower limits calculating processes executed by the control system.

The CPU 85*a* repeatedly executes an upper and lower limits calculating process in relation to the reading of the program. In the upper and lower limits calculating process, an upper limit and a lower limit both settable as rotational speeds of the main shaft of the sewing machine 1 are obtained by calculation. The process is shown in the flowchart of FIG. 5. Upon start of the upper and lower limits calculating process, the CPU 85*a* first determines whether the selected program includes sewing data such as stitch pitches (step S1). When the program includes no sewing data (NO at step S1), the CPU 85*a* advances to step S3 to set a maximum speed or an upper limit settable as the rotational speed of the main shaft at 2500 rpm and a minimum speed or a settable lower limit at 400 rpm. The maximum and minimum speeds are determined depending upon the mechanical construction of the sewing machine 1. The rotational speed of the main shaft of the sewing machine 1 can freely be set within a range between the maximum and minimum speeds unless the rotational speed is restricted by the program etc.

On the other hand, when the selected program includes sewing data (YES at step S1), the CPU 85*a* detects a minimum value of the stitch pitch from the sewing data to thereby determine whether the minimum value is at or below 3.0 mm (step S5). The main shaft can be rotated at the maximum speed in a sewing section in which the stitch pitch is at or below 3.0 mm. When the minimum value of the stitch pitch is at or below 3.0 mm (YES at step S5), the CPU 85*a* advances to step S3 to set the maximum speed of the main shaft at 2500 rpm and the minimum speed at 400 rpm, then returning. When the minimum value of the stitch pitch exceeds 3.0 mm (NO at step S5), the CPU 85*a* advances to step S9 to determine whether the minimum value of the stitch pitch is at or below 3.5 mm. The main shaft can be rotated at the maximum speed of 2300 rpm in a sewing section in which the stitch pitch is at or below 3.5 mm. When the minimum value of the stitch pitch is larger than 3.0 mm and at or below 3.5 mm (YES at step S9), the CPU 85*a* advances to step S11 to set the maximum speed of the main shaft at 2300 rpm and the minimum speed at 400 rpm, then returning.

Thus, the rotational speed of the main shaft is set so that the settable maximum value is decreased with an increase in the minimum value of the stitch pitch, in the manner as described above. More specifically, the maximum and minimum speeds of the main shaft are set at 2000 rpm and 400 rpm respectively (step S15) when the minimum value of the stitch pitch is larger than 3.5 mm and at or below 4.0 mm (YES at step S13). The maximum and minimum speeds of the main shaft are set at 1800 rpm and 400 rpm respectively (step S19) when the minimum value of the stitch pitch is larger than 4.0 mm and at or below 5.0 mm (YES at step S17). The maximum and minimum speeds of the main shaft are set at 1500 rpm and 400 rpm respectively (step S23) when the minimum value of the stitch pitch is larger than 5.0 mm and at or below 6.0 mm (YES at step S21). The maximum and minimum speeds of the main shaft are set at 1000 rpm and 400 rpm respectively (step S25) when the minimum value of the stitch pitch is larger than 6.0 mm (NO at step S21).

Figure 6:
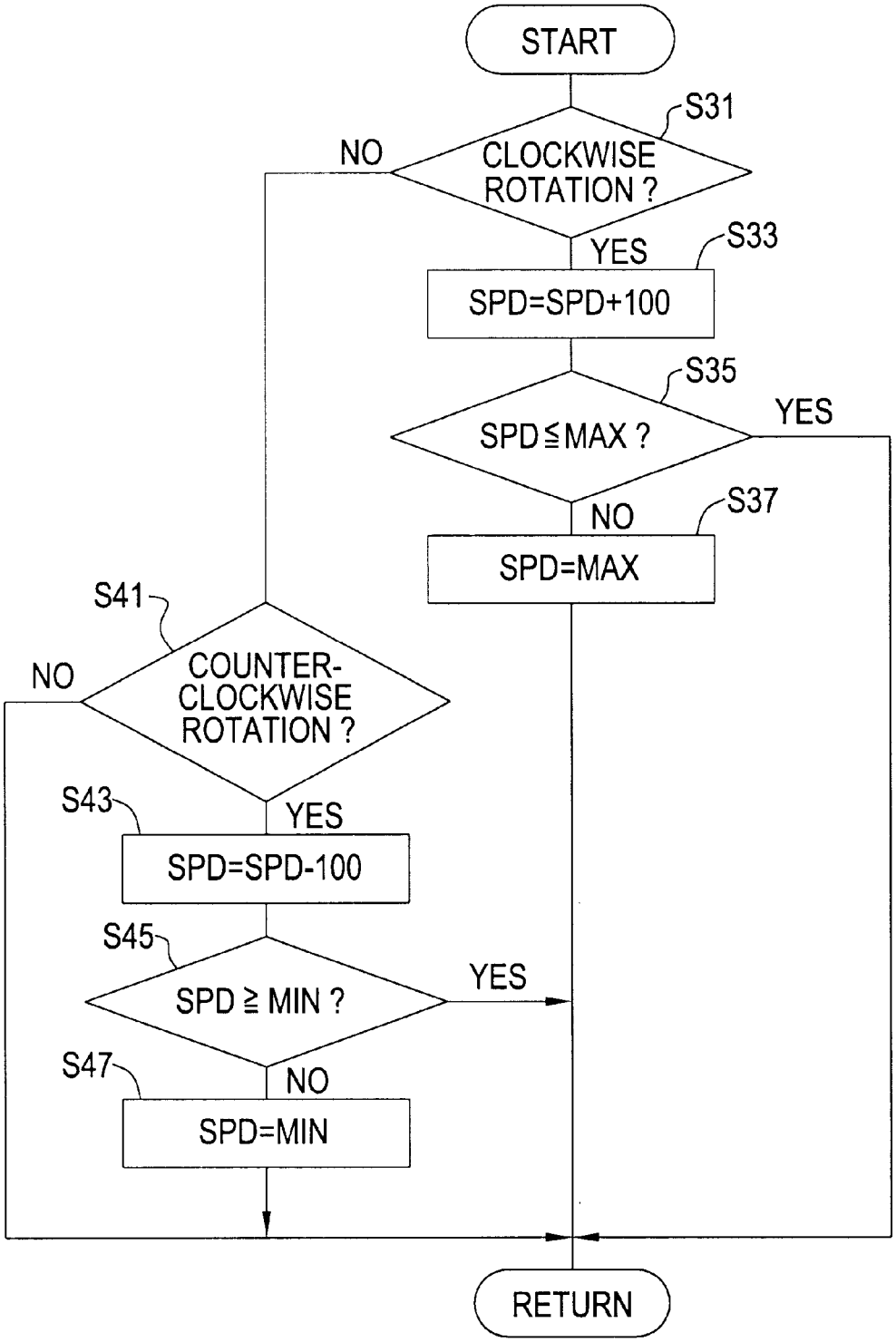
FIG. 6 is a flowchart showing a speed setting process executed by the control system.

Thereafter, when the user operates the menu selecting switch 59 to select the item of "SPEED," for example, the CPU 85*a* turns on the menu lamp 61 corresponding to the item of "SPEED" and repeatedly executes the following speed setting process. This speed setting process is executed to set a variable SPD representative of a set value of speed of the main shaft in the unit of rpm. The process is shown in the flowchart of FIG. 6. The rotational speed of the main shaft is automatically decreased by various safety arrangements in the sewing section in which the stitch pitch is large so that the sewing operation cannot be executed at the set SPD. During the speed setting process, the CPU 85*a* controls the displays 65 so that the value of the currently set SPD is displayed thereon in the unit of 10 rpm. In other words, the displays 65 display the speed of the main shaft changed in the speed setting process or theretofore set speeds of the main shaft.

Upon start of the speed setting process, the CPU 85*a* reads data of the operated state of the dial 63 at step S31 to determine whether the dial 63 has been turned clockwise. When the dial 63 has been turned clockwise (YES at step S31), the CPU 85*a* advances to step S33 to add 100 to the value of the SPD, then advancing to step S35. The CPU 85*a* compares the value of the SPD after the addition with the maximum speed MAX of the main shaft calculated in the above-described upper and lower limits calculating process. When SPD≦MAX (YES at step S35), the CPU 85*a* terminates the processing or returns to the initial state. When SPD>MAX (NO at step S35), the CPU 85*a* advances to step S37 to substitute the above maximum speed MAX for the value of SPD, terminating the processing.

On the other hand, when the dial 63 has not been turned clockwise (NO at step S31), the CPU 85*a* advances to step S41 to determine whether the dial 63 has been turned counter-clockwise. When the dial 63 has been turned counter-clockwise (YES at step S41), the CPU 85*a* advances to step S43 to subtract 100 from the value of the SPD, further advancing to step 545. The CPU 85*a* compares the value of the SPD after the subtraction with the minimum speed MIN of the main shaft calculated in the above-described upper and lower limits calculating process. When SPD≧MIN (YES at step S45), the CPU 85*a* terminates the processing or returns to the initial state. When SPD<MIN (NO at step S45), the CPU 85*a* advances to step S47 to substitute the above minimum speed MIN for the value of SPD, terminating the processing. Furthermore, when the dial 63 has been turned neither clockwise nor counterclockwise or has not been operated (No at step S41), the CPU 85*a* terminates the processing without changing the value of the SPD. The value of the SPD changed or unchanged in the speed setting process is displayed on the 7-segment displays 65.

According to the above-described sewing machine 1, the value of the SPD currently set as the speed of the main shaft is displayed on the 7-segment type displays 65. Consequently, the sewing speed set in the sewing machine 1 can readily be obtained. The upper and lower limits calculating process is executed so that the maximum and minimum speeds MAX and MIN both settable as the rotational speeds of the main shaft are obtained. Furthermore, the speed setting process is executed so that the value of the SPD changed according to an amount of turn of the dial 63 is ranged between the MAX and the MIN. See steps S35, S37, S45 and S47. When the dial 63 is turned clockwise to increase the SPD, both the value displayed on the displays 65 and the set value of the main shaft speed are increased according to an amount of turn of the dial 63. When the SPD becomes equal to the MAX, the value displayed on the displays 65 is not changed even if the dial 63 is further turned clockwise. Furthermore, the safety arrangements provided in the sewing machine 1 prohibit further change of the value of the SPD. Additionally, when the dial 63 is turned counterclockwise to decrease the SPD to the minimum speed MIN serving as the settable lower limit, the value displayed on the displays 65 is not further changed. Thus, the set rotational speed of the main shaft can be displayed as the substantial numeric value according to the selected program. Consequently, the cycle time etc. can be calculated accurately and readily.

In the foregoing embodiment, the CPU 85*a* and the programs executed by the CPU 85*a* or those executed for control of the sewing operation constitute sewing control means in the invention. The dial 63, the CPU 85*a* and the control program executed by the CPU 85*a* for the speed setting process in FIG. 6 constitute rotational speed setting means in the invention. Furthermore, the CPU 85*a* and the control program executed by the CPU 85*a* for the upper and lower limits calculating process in FIG. 5 constitute upper limit calculating means and lower limit calculating means in the invention. Additionally, the displays 65, the CPU 85*a* and the control program executed by the CPU 85*a* for the speed setting process in FIG. 6 constitute displaying means in the invention.

The maximum and minimum speeds of the main shaft are calculated in the upper and lower limits calculating process in the foregoing embodiment. However, only the maximum speed may be calculated, instead. Although the maximum speed is calculated on the basis of the minimum value of the stitch pitch in the foregoing embodiment, the maximum speed may be calculated on the basis of the maximum value of the stitch pitch, instead.

In a sewing section where the stitch pitch becomes minimum, the main shaft is rotated at the highest speed. Accordingly, the maximum speed of the main shaft calculated on the basis of this sewing section corresponds to a largest value of the main shaft speed throughout the entire sewing process. Furthermore, in the pattern sewing such as the name sewing, a number of small stitch pitches are continuously used to form patterns such as characters or figures, whereas relatively large stitch pitches are used only for underlay portions of the characters or figures. Accordingly, the small stitch pitches are employed in almost all the sections of the sewing process in the sewing machine 1 which executes the above-described pattern sewing. Consequently, the numeric value of the SPD more accurately corresponding to the sewing speed can be displayed when the maximum speed is calculated on the basis of the minimum value of the stitch pitch. This can provide further accurate and easy calculation of the cycle time etc.

On the other hand, the main shaft is rotated at the lowest speed in the section where the stitch pitch become maximum. Accordingly, when the rotational speed of the main shaft is set at or below the maximum speed calculated on the basis of this lowest speed section, the set rotational speed can be maintained through the entire sewing process. Consequently, in the sewing machine of the type in which the speed of the main shaft is maintained at a fixed value, the numeric value of the SPD more accurately corresponding to the sewing speed can be displayed when the maximum speed is calculated on the basis of the maximum value of the stitch pitch. This can provide further accurate and easy calculation of the cycle time etc. This type of sewing machine includes those of the type in which a great importance is attached to the quality of sewn products, and those in which the main shaft needs to be set at low speeds due to limitations of the mechanical construction or accessories.

Figure 7A:
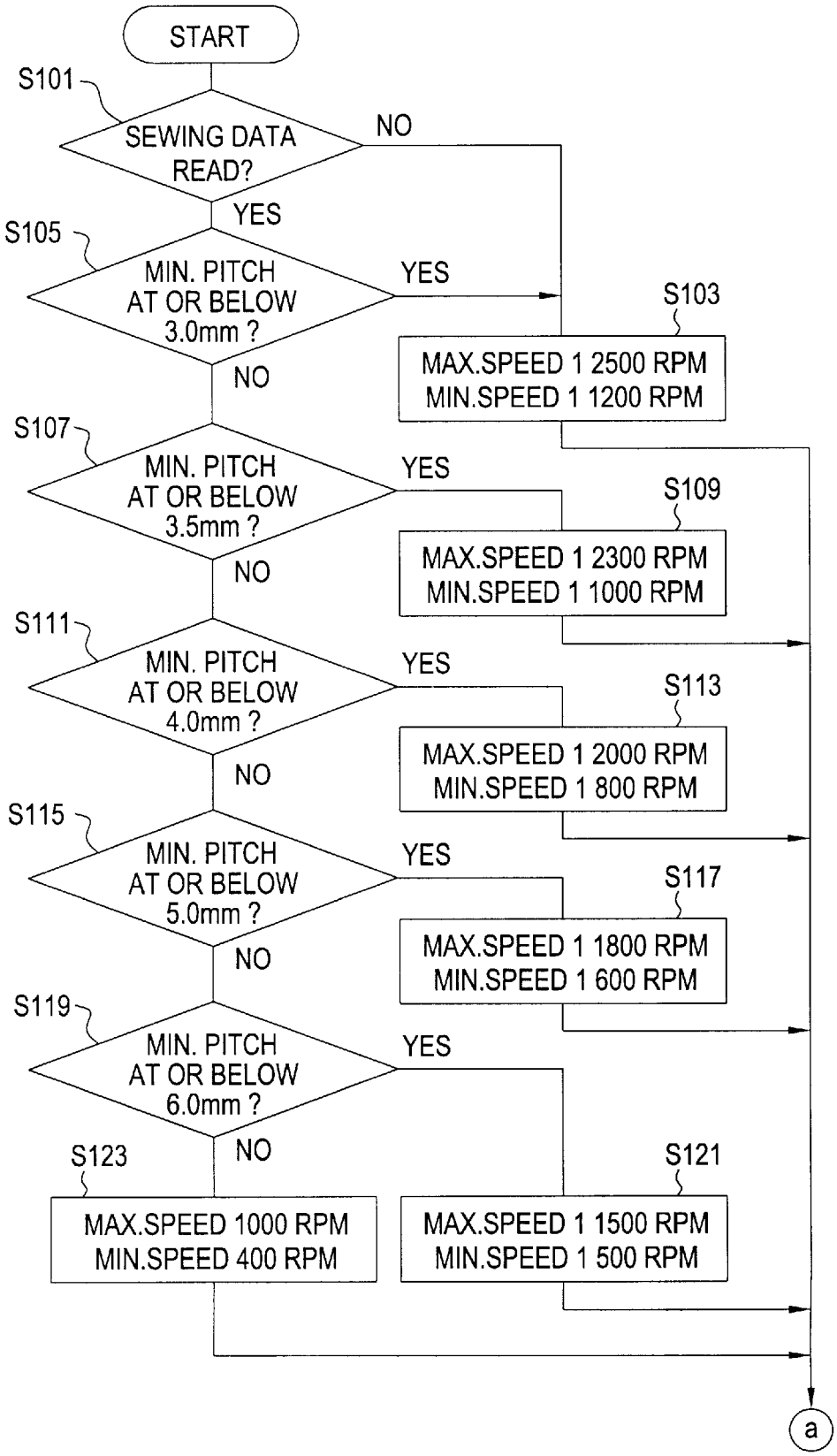
FIG. 7A is a flowchart showing the upper and lower limits calculating processes executed in the control system of the programmable electronic sewing machine of a second embodiment in accordance with the present invention.
Figure 7B:
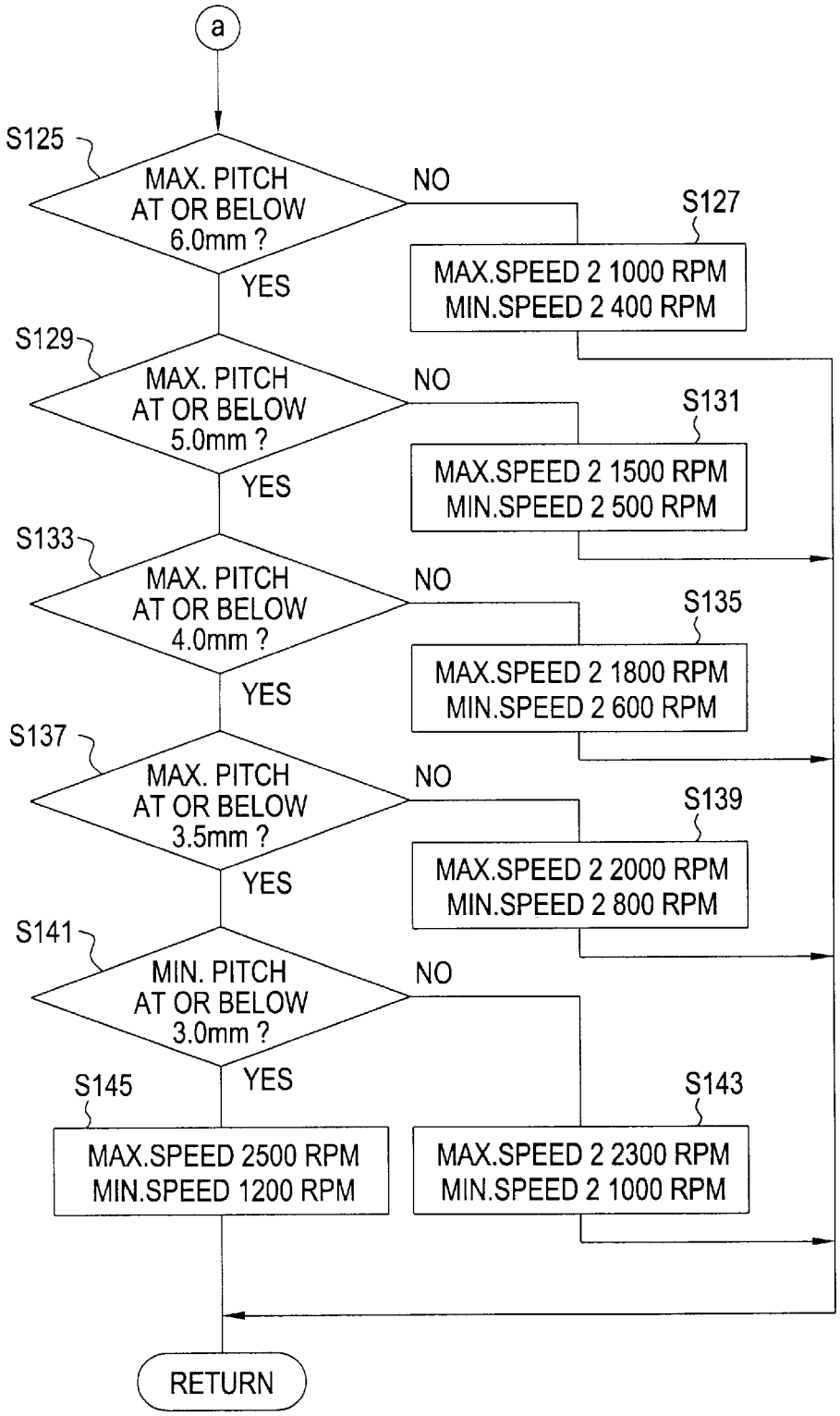
FIG. 7B is a flowchart showing the upper and lower limits calculating processes carried out following the processes in FIG. 7A.

FIGS. 7A and 7B illustrate a second embodiment of the invention. Differences between the first and second embodiments will be described. In the second embodiment, a plurality of, e.g., two, upper limits and a plurality of, e.g., two, lower limits both settable as rotational speeds of the main shaft are calculated so as to correspond to a plurality of sewing conditions respectively. The control contents for processes for setting the plurality of upper and lower limits are shown in the flowcharts of FIGS. 7 and 8.

The CPU 85*a* first determines whether the program read from the floppy disk includes sewing data such as stitch pitches (step S101 in FIG. 7A). When the program includes no sewing data (NO at step S101), the CPU 85*a* advances to step S103 to set a maximum speed 1 or a first upper limit settable as the rotational speed of the main shaft at 2500 rpm and a minimum speed 1 or a settable first lower limit at 1200 rpm, then advancing to step S125 in FIG. 7B. On the other hand, when the read program includes sewing data (YES at step S101), the CPU 85*a* detects a minimum value of the stitch pitch from the sewing data to thereby determine whether the minimum value is at or below 3.0 mm (step S105).

The main shaft can be rotated at the maximum speed 1 of 2500 rpm in a sewing section in which the stitch pitch is at or below 3.0 mm. When the minimum value of the stitch pitch is at or below 3.0 mm (YES at step S105), the CPU 85*a* advances to step S103 to set the maximum speed 1 of the main shaft at 2500 rpm and the minimum speed 1 at 1200 rpm, then advancing to step S125 in FIG. 7B.

When the minimum value of the stitch pitch exceeds 3.0 mm (NO at step S105), the CPU 85*a* advances to step S107 to determine whether the minimum value of the stitch pitch is at or below 3.5 mm. The main shaft can be rotated at the maximum speed 1 of 2300 rpm in a sewing section in which the stitch pitch is at or below 3.5 mm. When the minimum value of the stitch pitch is larger than 3.0 mm and at or below 3.5 mm (YES at step S107), the CPU 85*a* advances to step S109 to set the maximum speed 1 of the main shaft at 2300 rpm and the minimum speed 1 at 1000 rpm, then advancing to step S125 in FIG. 7B.

Thereafter, the rotational speed of the main shaft is set so that the maximum and minimum values settable as the speeds of the main shaft are decreased with an increase in the minimum value of the stitch pitch, in the manner as described above. More specifically, the maximum and minimum speeds 1 of the main shaft are set at 2000 rpm and 800 rpm respectively (step S113) when the minimum value of the stitch pitch is larger than 3.5 mm and at or below 4.0 mm (YES at step S111). The maximum and minimum speeds 1 of the main shaft are set at 1800 rpm and 600 rpm respectively (step S117) when the minimum value of the stitch pitch is larger than 4.0 mm and at or below 5.0 mm (YES at step S115). The maximum and minimum speeds 1 of the main shaft are set at 1500 rpm and 500 rpm respectively (step S121) when the minimum value of the stitch pitch is larger than 5.0 mm and at or below 6.0 mm (YES at step S119). The maximum and minimum speeds 1 of the main shaft are set at 1000 rpm and 400 rpm respectively (step S123) when the minimum value of the stitch pitch is larger than 6.0 mm (NO at step S119).

After going through the processes in FIG. 7A, the CPU 85*a* advances to step S125 in FIG. 7B to detect a maximum value of the stitch pitch in the read sewing data and to determine whether the detected maximum value is at or below 6.0 mm. The maximum and minimum speeds 2 of the main shaft are set at 1000 rpm and 400 rpm respectively (step S127) when the maximum value of the stitch pitch exceeds 6.0 mm (NO at step S125). On the other hand, when the maximum value of the stitch pitch is at or below 6.0 mm (YES at step S125), the CPU 85*a* advances to step S129 to determine whether the maximum value of the stitch pitch is at or below 5.0 mm. When the maximum value of the stitch pitch is at or below 6.0 mm and larger than 5.0 mm (NO at step S129), the CPU 85*a* advances to step S131 to set the maximum and minimum speeds 2 of the main shaft at 1500 rpm and 500 rpm, then returning.

Thereafter, the rotational speed of the main shaft is set so that the maximum and minimum values settable as the speeds of the main shaft are increased with a decrease in the maximum value of the stitch pitch, in the manner as described above. More specifically, the maximum and minimum speeds 2 of the main shaft are set at 1800 rpm and 600 rpm respectively (step S135) when the maximum value of the stitch pitch is at or below 5.0 mm and larger than 4.0 mm (NO at step S133). The maximum and minimum speeds 2 of the main shaft are set at 2000 rpm and 800 rpm respectively (step S139) when the maximum value of the stitch pitch is at or below 4.0 mm and larger than 3.5 mm (NO at step S137). The maximum and minimum speeds 2 of the main shaft are set at 2300 rpm and 1000 rpm respectively (step S143) when the maximum value of the stitch pitch is at or below 3.5 mm and larger than 3.0 mm (NO at step S141). The maximum and minimum speeds 2 of the main shaft are set at 2500 rpm and 1200 rpm respectively (step S145) when the maximum value of the stitch pitch is at or below 3.0 mm (YES at step S141).

In the second embodiment, the maximum speeds 1 and 2 of the main shaft correspond to the plurality of upper limits settable as the rotational speeds of the main shaft respectively. Furthermore, the maximum speed 1 corresponds to the maximum value of the plurality of upper limits, whereas the maximum speed 2 corresponds to the minimum value of the plurality of upper limits. The minimum speed 1 corresponds to the maximum value of the plurality of lower limits, whereas the minimum speed 2 corresponds to the minimum value of the plurality of lower limits. Which of the two maximum speeds 1 and 2 should be used as the upper limit in displaying the rotational speed is determined depending upon the type, specification, etc. of the sewing machine. Also, which of the two minimum speeds 1 and 2 should be used as the lower limit in displaying the rotational speed is determined depending upon the type, specification, etc. of the sewing machine.

For example, when the sewing data includes the stitch pitches of 3 mm, 4 mm and 5 mm, the maximum speed 1 of 2500 rpm, the maximum speed 2 of 1800 rpm, the minimum speed 1 of 1200 rpm and the minimum speed 2 of 600 rpm are obtained as the result of execution of the upper and lower limits calculating process as shown in FIGS. 7 and 8.

The two maximum speeds 1 and 2 are calculated as the plurality of upper limits settable as the rotational speeds of the main shaft in the second embodiment. However, three or more maximum speeds may be calculated, instead. Also, although the two minimum speeds 1 and 2 are calculated as the plurality of settable lower limits as the rotational speeds of the main shaft, three or more minimum speeds may be calculated, instead. Furthermore, the lower limits or minimum speeds depend upon mechanical conditions, sewing conditions of the sewing machine such as the sewing pitch, the resolution of the speed adjusting dial, etc. Accordingly, the lower limits or minimum speeds may be fixed as in the first embodiment according to the conditions, or may be variable as in the second embodiment.

The invention may be applied to a programmable electronic sewing machine in which the cloth presser is moved in an R-θ direction in the polar coordinates or a sewing machine such as a pocket setter for sewing pockets on clothing fabrics. Furthermore, various programs for operating the sewing machine 1 are recorded in the ROM 85*b* of the control system. However, the sewing machine 1 may be provided with a reader for reading the program stored in the flexible disk, the CDROM or the IC card, so that the program is entered into the sewing machine 1 via the recording medium. In this arrangement, a flush memory or hard disk system is preferably provided in the sewing machine for storing the program.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A programmable electronic sewing machine comprising:

sewing control means for controlling sections of the machine including a main shaft on the basis of a preset program so that a sewing operation is executed;

rotational speed setting means for setting a rotational speed of the main shaft according to an amount of operation thereof;

upper limit calculating means for calculating an upper limit settable as the rotational speed of the main shaft on the basis of the preset program; and displaying means for displaying the rotational speed of the main shaft currently set by the rotational speed setting means with the upper limit calculated by the upper limit calculating means serving as an upper limit of the displayed rotational speed.

2. A sewing machine according to claim 1, which further comprises lower limit calculating means for calculating a lower limit settable as the rotational speed of the main shaft, and wherein the displaying means displays the currently set rotational speed of the main shaft with the upper and lower limits serving as the upper limit and a lower limit of the displayed rotational speed respectively.

3. A sewing machine according to claim 1, wherein the upper limit calculating means reads the program to detect a minimum value of a stitch pitch and calculates the upper limit on the basis of the detected minimum value of the stitch pitch.

4. A sewing machine according to claim 2, wherein the upper limit calculating means reads the program to detect a minimum value of a stitch pitch and calculates the upper limit on the basis of the detected minimum value of the stitch pitch.

5. A sewing machine according to claim 1, wherein the upper limit calculating means reads the program to detect a maximum value of a stitch pitch and calculates the upper limit on the basis of the detected maximum value of the stitch pitch.

6. A sewing machine according to claim 2, wherein the upper limit calculating means reads the program to detect a maximum value of a stitch pitch and calculates the upper limit on the basis of the detected maximum value of the stitch pitch.

7. A sewing machine according to claim 1, wherein the upper limit calculating means calculates a plurality of upper limits each settable as the rotational speed of the main shaft and corresponding to a plurality of sewing conditions respectively on the basis of the program, and the displaying means displays the rotational speed set according to the amount of operation of the speed setting means with the maximum of the plurality of upper limits serving as the upper limit.

8. A sewing machine according to claim 7, which further comprises lower limit calculating means for calculating a lower limit settable as the rotational speed of the main shaft, and wherein the displaying means displays the currently set rotational speed of the main shaft with the upper and lower limits serving as the upper limit and a lower limit of the displayed rotational speed respectively.

9. A sewing machine according to claim 1, wherein the upper limit calculating means calculates a plurality of upper limits each settable as the rotational speed of the main shaft and corresponding to a plurality of sewing conditions respectively on the basis of the program, and the displaying means displays the rotational speed set according to the amount of operation of the speed setting means with a minimum of the plurality of upper limits serving as the upper limit.

10. A sewing machine according to claim 9, which further comprises lower limit calculating means for calculating a lower limit settable as the rotational speed of the main shaft, and wherein the displaying means displays the currently set rotational speed of the main shaft with the upper and lower limits serving as the upper limit and a lower limit of the displayed rotational speed respectively.

11. A recording medium for recording a program for operating a programmable electronic sewing machine, the program accomplishing the functions of:

sewing control means for controlling sections of the machine including a main shaft on the basis of a preset program so that a sewing operation is executed;

rotational speed setting means for setting a rotational speed of the main shaft according to an amount of operation thereof;

upper limit calculating means for calculating an upper limit settable as the rotational speed of the main shaft on the basis of the preset program; and displaying means for displaying the rotational speed of the main shaft currently set by the rotational speed setting means with the upper limit calculated by the upper limit calculating means serving as an upper limit of the displayed rotational speed.

12. A recording medium according to claim 11, wherein the program further accomplishes the function of lower limit calculating means for calculating a lower limit settable as the rotational speed of the main shaft, and wherein the displaying means displays the currently set rotational speed of the main shaft with the upper and lower limits serving as the upper limit and a lower limit of the displayed rotational speed respectively.

13. A recording medium according to claim 11, wherein the upper limit calculating means reads the program to detect a minimum upper of a stitch pitch and calculates the upper limit on the basis of the detected minimum value of the stitch pitch.

14. A recording medium according to claim 12, wherein the upper limit calculating means reads the program to detect a minimum value of a stitch pitch and calculates the upper limit on the basis of the detected minimum value of the stitch pitch.

15. A recording medium according to claim 11, wherein the upper limit calculating means reads the program to detect a maximum value of a stitch pitch and calculates the upper limit on the basis of the detected maximum value of the stitch pitch.

16. A recording medium according to claim 12, wherein the upper limit calculating means reads the program to detect a maximum value of a stitch pitch and calculates the upper limit an the basis of the detected maximum value of the stitch pitch.

17. A recording medium according to claim 11, wherein the upper limit calculating means calculates a plurality of upper limits each settable as the rotational speed of the main shaft and corresponding to a plurality of sewing conditions respectively on the basis of the program, and the displaying means displays the rotational speed set according to the amount of operation of the speed setting means with the maximum of the plurality of upper limits serving as the upper limit.

18. A recording medium according to claim 17, which further accomplishes the function of lower limit calculating means for calculating a lower limit settable as the rotational speed of the main shaft, and wherein the displaying means displays the currently set rotational speed of the main shaft with the upper and lower limits serving as the upper limit and a lower limit of the displayed rotational speed respectively.

19. A recording medium according to claim 11, wherein the upper limit calculating means calculates a plurality of upper limits each settable as the rotational speed of the main shaft and corresponding to a plurality of sewing conditions respectively on the basis of the program, and the displaying means displays the rotational speed set according to the amount of operation of the speed setting means with a minimum of the plurality of upper limits serving as the upper limit.

20. A recording medium according to claim 19, which further accomplishes the function of lower limit calculating means for calculating a lower limit settable as the rotational speed of the main shaft, and wherein the displaying means displays the currently set rotational speed of the main shaft with the upper and lower limits serving as the upper limit and a lower limit of the displayed rotational speed respectively.

* * * * *